US010017706B1

(12) United States Patent
Loebick et al.

(10) Patent No.: US 10,017,706 B1
(45) Date of Patent: Jul. 10, 2018

(54) ADDITIVE FOR COMBUSTION ENHANCEMENT OF LIQUID HYDROCARBON FUELS

(71) Applicant: Precision Combustion, Inc., North Haven, CT (US)

(72) Inventors: Codruta Loebick, North Haven, CT (US); Jeffrey Weissman, Guilford, CT (US)

(73) Assignee: PRECISION COMBUSTION, INC., North Haven, CT (US)

( * ) Notice: Subject to any disclaimer, the term of this patent is extended or adjusted under 35 U.S.C. 154(b) by 610 days.

(21) Appl. No.: 14/665,395

(22) Filed: Mar. 23, 2015

Related U.S. Application Data

(60) Provisional application No. 61/995,091, filed on Apr. 2, 2014.

(51) Int. Cl.

| | |
|---|---|
| ***C10L 1/00*** | (2006.01) |
| ***C10L 1/22*** | (2006.01) |
| ***F23J 7/00*** | (2006.01) |
| *C10L 1/224* | (2006.01) |

(52) U.S. Cl.
CPC . *C10L 1/22* (2013.01); *F23J 7/00* (2013.01); *C10L 1/224* (2013.01); *C10L 2200/0259* (2013.01); *C10L 2230/22* (2013.01); *C10L 2270/04* (2013.01)

(58) Field of Classification Search
CPC ..... C10L 1/22; C10L 2200/0259; C10L 2230/22; C10L 2270/04; F23J 7/00
See application file for complete search history.

(56) References Cited

U.S. PATENT DOCUMENTS 6,187,823 B1 2/2001 Haddon
8,183,180 B2 * 5/2012 Tour ..... B82Y 30/00 423/414

(Continued)

FOREIGN PATENT DOCUMENTS

CN 102328926 A 1/2012
CN 102746236 A 10/2012

(Continued)

OTHER PUBLICATIONS

Kish et al., Increasing the octane number of gasoline using functionalized carbon nanotubes, Applied Surface Science, 256(2010) 3472-3477.*

(Continued)

*Primary Examiner* — Cephia D Toomer
(74) *Attorney, Agent, or Firm* — Mane F. Zuckerman; Andrew D. Gathy

(57) ABSTRACT

A stabilized composition comprising a liquid hydrocarbon fuel, such as JP-8, and a fuel additive, wherein the fuel additive comprises a graphitic carbon compound functionalized with a plurality of alkyl groups, wherein at least one alkyl group at each site of alkyl functionalization on the graphitic carbon compound has 8 or more carbon atoms, for example, poly(octadecyl)-graphene oxide. A method of increasing the energy density of a liquid hydrocarbon fuel involving adding to the fuel one or more alkyl-functionalized graphitic carbon compounds. The stabilized composition is useful for enhancing the properties of combustion processes, including energy density, thrust, flame speed, or a combination thereof, without introducing undesirable combustion effects, emissions, or combustion signature.

22 Claims, 5 Drawing Sheets

(56) References Cited

U.S. PATENT DOCUMENTS

Figure 1:
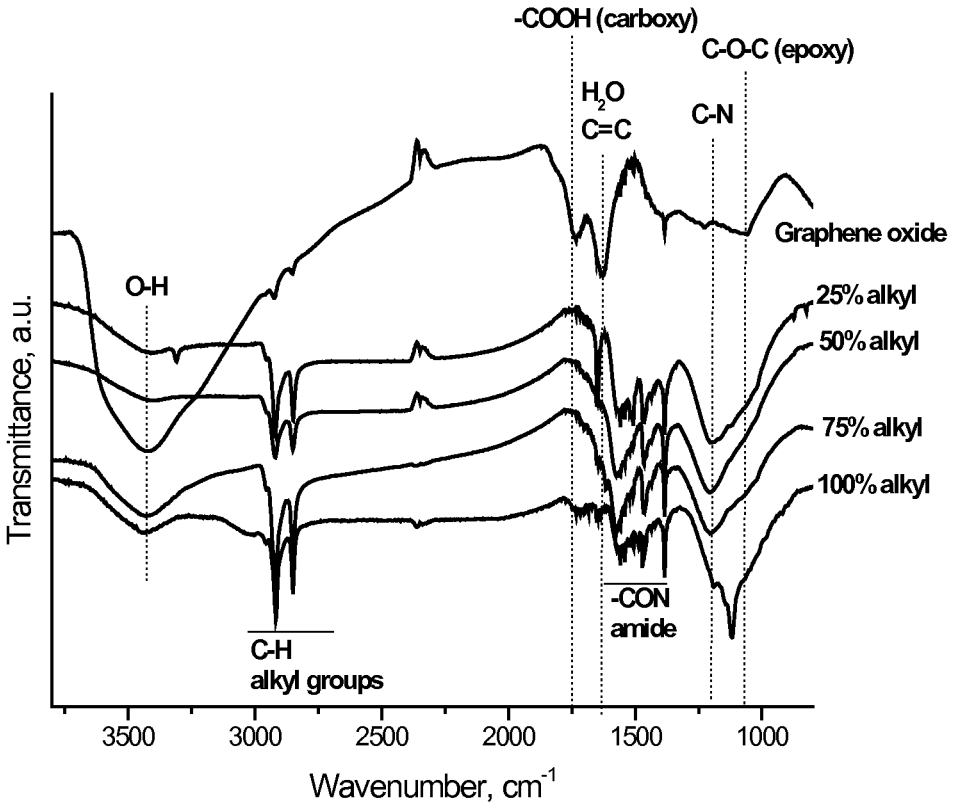

| | | | | |
|---|---|---|---|---|
| 9,156,701 | B2 * | 10/2015 | Ho | B82Y 30/00 |
| 2003/0024884 | A1 | 2/2003 | Petrik | |
| 2006/0191835 | A1 | 8/2006 | Petrik | |
| 2007/0092432 | A1 * | 4/2007 | Prud'Homme | H01G 4/206 423/448 |
| 2011/0114897 | A1 | 5/2011 | Aksay | |
| 2013/0330833 | A1 | 12/2013 | Ruiz | |
| 2014/0079932 | A1 | 3/2014 | Aksay | |

FOREIGN PATENT DOCUMENTS

| | | | |
|---|---|---|---|
| CN | 102895979 | A | 1/2013 |
| CN | 102899122 | A | 1/2013 |
| CN | 103007947 | A | 4/2013 |
| CN | 103073930 | A | 5/2013 |
| CN | 103087411 | A | 5/2013 |

OTHER PUBLICATIONS

Co-pending U.S. Appl. No. 15/582,813, filed May 1, 2017, entitled "High Capacity Regenerable Graphene-Based Sorbent"; Inventor: C. M. Zoican-Loebick.

H. Tyagi, P. E. Phelan, R. Prasher, R. Peck, T. Lee, J. R. Pacheco, and P. Arentzen "Increased Hot-Plate Ignition Probability for Nanoparticle-Laden Diesel Fuel," Nano Letters, 2008, vol. 8 (5), 1410-1416.

J. L. Sabourin, D. M. Dabbs, R. A. Yetter, F. L. Dryer, and I. A. Aksay, "Functionalized Graphene Sheet Colloids for Enhanced Fuel/Propellant Combustion," ACS Nano, 2009, vol. 3 (12), 3945-3954.

H. C. Schniepp, J-L Li, M. J. McAllister, H. Sai, M. Herrera-Alonso, D. H. Adamson, R. K. Prud'homme, R. Car, D. A. Saville, and I. A. Aksay, "Functionalized Single Graphene Sheets Derived from Splitting Graphite Oxide," The Journal of Physical Chemistry B, Letters, 2006, vol. 110, 8535-8539.

S. Choudhary, H. P. Mungse, and O. P. Khatri, "Dispersion of Alkylated Graphene in Organic Solvents and Its Potential for Lubrication Applications," Journal of Materials Chemistry, 2012, vol. 22, 21032-21039.

D. R. Dreyer, S. Park, C. W. Bielawski, and R. S. Ruoff, "The Chemistry of Graphene Oxide," Chemical Society Reviews, 2010, vol. 39, 228-240.

M. Terrones, "Science and Technology of the Twenty-First Century: Synthesis, Properties, and Applications of Carbon Nanotubes," Annual Review of Materials Research, 2003, vol. 33, 419-501.

D. Tasis, N. Tagmatarchis, V. Georgakilas, and M. Prato, "Soluble Carbon Nanotubes," Chem. Eur. J. 2003, 9., pp. 4000-4008.

* cited by examiner

ADDITIVE FOR COMBUSTION ENHANCEMENT OF LIQUID HYDROCARBON FUELS

GOVERNMENT RIGHTS

This invention was made with support from the United States government under Contract No. FA9300-13-M-1005, awarded by the Department of Defense (Air Force). The United States government has certain rights in the invention.

CROSS-REFERENCE TO RELATED APPLICATIONS

The present invention is a nonprovisional application of U.S. Provisional Application Ser. No. 61/995,091, filed on Apr. 2, 2014, entitled "Additive for Combustion Enhancement of Liquid Hydrocarbon Fuels", the contents of which are incorporated herein by reference.

FIELD OF THE INVENTION

In a first aspect, this invention pertains to a stabilized composition comprising a liquid hydrocarbon fuel and a fuel additive for enhancing properties of the fuel, preferably, combustion properties of the fuel. In a second aspect, this invention pertains to a method of enhancing combustion properties of a liquid hydrocarbon fuel, either by enhancing energy density, thrust, or flame speed, or a combination thereof. In a third aspect, this invention pertains to a combustion process employing the stabilized composition comprising the liquid hydrocarbon fuel and the fuel additive for enhancing combustion properties of the fuel. Applications relate to both military and non-military uses of liquid hydrocarbon fuels.

BACKGROUND OF THE INVENTION

Long-term availability of liquid hydrocarbon fuels for transportation and military propulsion operations remains a present concern in view of increasing demand and shrinking energy resources. It is known that some nano-particle energetic materials can be employed as fuel additives to enhance combustion properties of solid fuels. Nano-particle energetic materials can advantageously increase a solid fuel's energy density and/or can enable higher engine performance through increased thrust and range, reduced fuel consumption, and reduced emissions. Increased energy density typically results in faster ignition and higher burn rates. In addition, nano-particle fuel additives can increase the availability of propulsion grade fuels. For these purposes, the art generally recognizes the term "nano-particle" to refer to particles having three dimensions falling within a nanometer scale, typically, ranging from about 1 nm to less than about 300 nm. Due to their high surface area to volume ratio, nano-particles offer distinct advantages over larger scale particles, such as micro-sized particles; for example, nano-particles offer increased surface area and may improve radiative heat transfer properties.

Nano-particle energetic materials known for their fuel-enhancing properties include nano-particles of various metals and metalloids, their hydroxides, oxyhydroxides, and oxides, among them aluminum oxide and silicon oxide being well recognized. Such particles can be readily mixed with solid fuels and propellants to advantageous benefit. See, for example, the disclosure of H. Tyagi, et al., "Increased Hot-Plate Ignition Probability for Nanoparticle-Laden Diesel Fuel," Nano Letters, Vol, 8., No. 5., 2008, pp. 1410-1416.

Addition of nano-particle fuel additives to liquid hydrocarbon fuels, such as diesel and JP-8, is less studied, because such particles cannot be solubilized or stably dispersed in the liquid fuel. Even as colloidal suspensions and gels, nano-particles lose stability, agglomerate, and sediment from liquid hydrocarbon fuels. Moreover, metal and metalloid nano-particles can quickly oxidize during combustion and become inactive, resulting in emissions of environmentally unfriendly combustion by-products containing metals or metalloids and with reduced effect on the combustion properties of the fuel. Moreover upon combustion, metal and metalloid nano-particles will leave a detectable signature, which may be undesirable in military operations.

It is known to disperse functionalized graphene as a colloid in nitromethane, a liquid monopropellant, as reported by J. L. Sabourin, et al., in "Functionalized Graphene Sheet Colloids for Enhanced Fuel/Propellant Combustion," ACS Nano, Vol. 3, No. 12, 2009, pp. 3945-3954. Graphene comprises a 2-dimensional, crystalline allotrope of carbon, in which carbon atoms are densely packed in a regular array of $sp^2$-bonded, atomic scale hexagonal pattern. Graphene can be described as a one-atom thick layer of graphite, as disclosed by H. Schniepp et. al., in "Functionalized Single Graphene Sheets Derived from Splitting Graphite Oxide," The Journal of Physical Chemistry B, vol. 110, 17, 2006, 8535-8539. In the context of the Sabourin publication, "functionalized graphene" refers to graphene functionalized on its surface with epoxy and hydroxyl groups and on its sides with hydroxyl and carboxyl groups. Hereinafter, these oxygen-containing groups will be referenced collectively as "oxygen functionalization." Significantly, oxygen functionalization renders graphene polar and therefore compatible with nitromethane, which is a polar liquid at ambient temperature and pressure. In addition, oxygen-functionalized graphene dispersed within nitromethane enhances ignition and combustion rates, as taught by J. L. Sabourin, et al.

The art discloses that oxygen-functionalized graphene cannot be solubilized in non-polar liquid hydrocarbon solvents. In contrast, prior work in lubricant development has found that graphene alkylated with long-chain alkyl groups can be solubilized and dispersed in certain pure organic solvents, such as toluene, hexane, and hexadecane for lubrication applications, as reported by S. Choudhary, et al. in "Dispersion of alkylated graphene in organic solvents and its potential for lubrication applications," Journal of Material Chemistry, Vol. 22 (2012), pp. 21032-21039.

As mentioned above, liquid hydrocarbon fuels provide an extra challenge in that conventional fuel additives cannot be solubilized or stably dispersed therein. It would be desirable to discover a fuel additive that can be solubilized and/or stably dispersed within a liquid hydrocarbon fuel for enhancing properties of the fuel, preferably, for the purpose of enhancing the fuel's energy density, thrust, flame speed, or combination thereof. It would be desirable for a mixture comprising the liquid hydrocarbon fuel and the fuel additive to be stably maintained in storage for long periods of time, for example, on the order of about one month or longer, without sedimentation or agglomeration of the fuel additive. It would be more desirable if the fuel additive did not contain a metal or metalloid, so as to eliminate environmentally unfriendly combustion by-products and emissions upon combustion. It would be even more desirable if such a fuel additive were itself combusted during the fuel combustion process without leaving a detectable signature.

SUMMARY OF THE INVENTION

In a first aspect, this invention provides for a stabilized composition comprising a liquid hydrocarbon fuel and a fuel additive, wherein the fuel additive comprises a graphitic carbon compound functionalized with a plurality of alkyl groups, wherein at least one alkyl group at each site of functionalization has at least 8 carbon atoms.

In a second aspect, this invention provides for a method of increasing the energy density of a liquid hydrocarbon fuel, the method comprising adding an effective amount of a fuel additive to the liquid hydrocarbon fuel, the fuel additive comprising a graphitic carbon compound functionalized with a plurality of alkyl groups, wherein at least one alkyl group at each site of functionalization has at least 8 carbon atoms.

In a third aspect, this invention provides for an oxidation process wherein a liquid hydrocarbon fuel is oxidized with an oxidant in the presence of the fuel additive comprising the graphitic carbon compound functionalized with a plurality of alkyl groups, wherein at least one alkyl group at each site of functionalization has at least 8 carbon atoms; the oxidation process occurring under reaction conditions sufficient to convert the liquid hydrocarbon fuel into at least one oxidized product.

We have found that polarity is an important issue in stabilizing an additive in a liquid hydrocarbon fuel. More particularly, we have discovered that whereas graphene that is oxygen-functionalized cannot be stabilized in diesel and JP-8 or other non-polar liquid hydrocarbon fuel; in contrast, graphene or graphene oxide that is alkylated with long-chain alkyl groups can be stabilized in such fuels, and that the resulting alkyl-functionalized graphitic carbon additive mixed with liquid hydrocarbon fuel can result in a range of useful fuel characteristics and performance effects, including increased energy density.

DRAWINGS

FIG. 1 presents spectra plotting infrared transmittance as a function of wavenumber for samples of 25%, 50%, 75%, and 100% alkyl-functionalized graphene oxide, as compared with unmodified graphene oxide.

Figure 2:
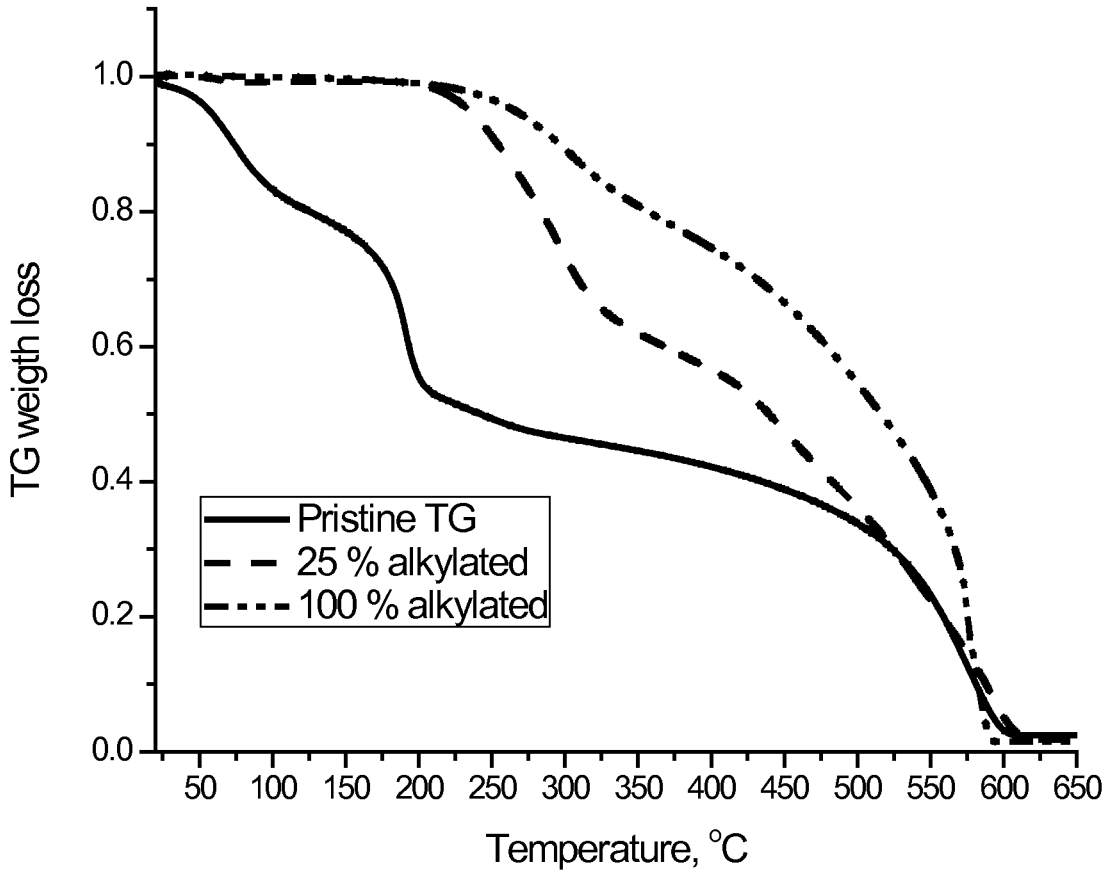

FIG. 2 provides a graph plotting thermogravimetric weight loss as a function of temperature for samples of 25% and 100% alkyl-functionalized graphene oxide, as compared with unmodified (or pristine) graphene oxide.

Figure 3:
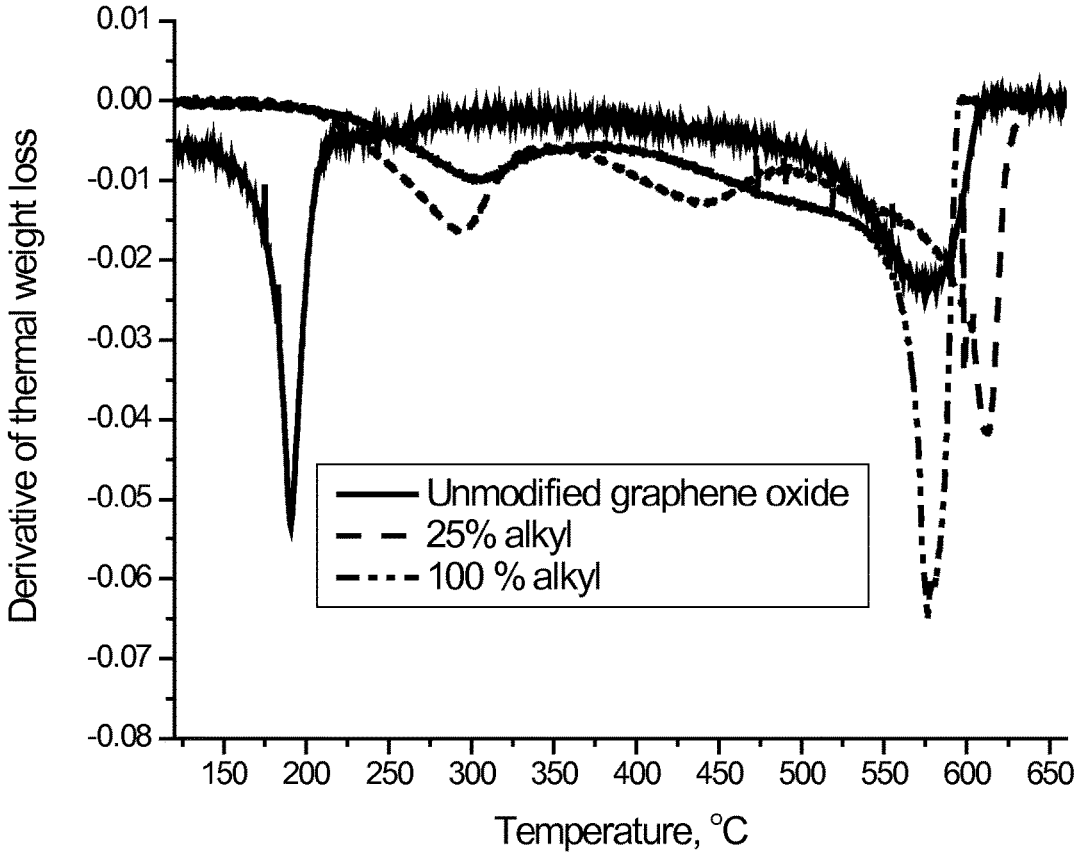

FIG. 3 provides a graph plotting the derivative of thermogravimetric weight loss as a function of temperature for samples of 25% and 100% alkyl-functionalized graphene oxide, as compared with unmodified graphene oxide.

Figure 4:
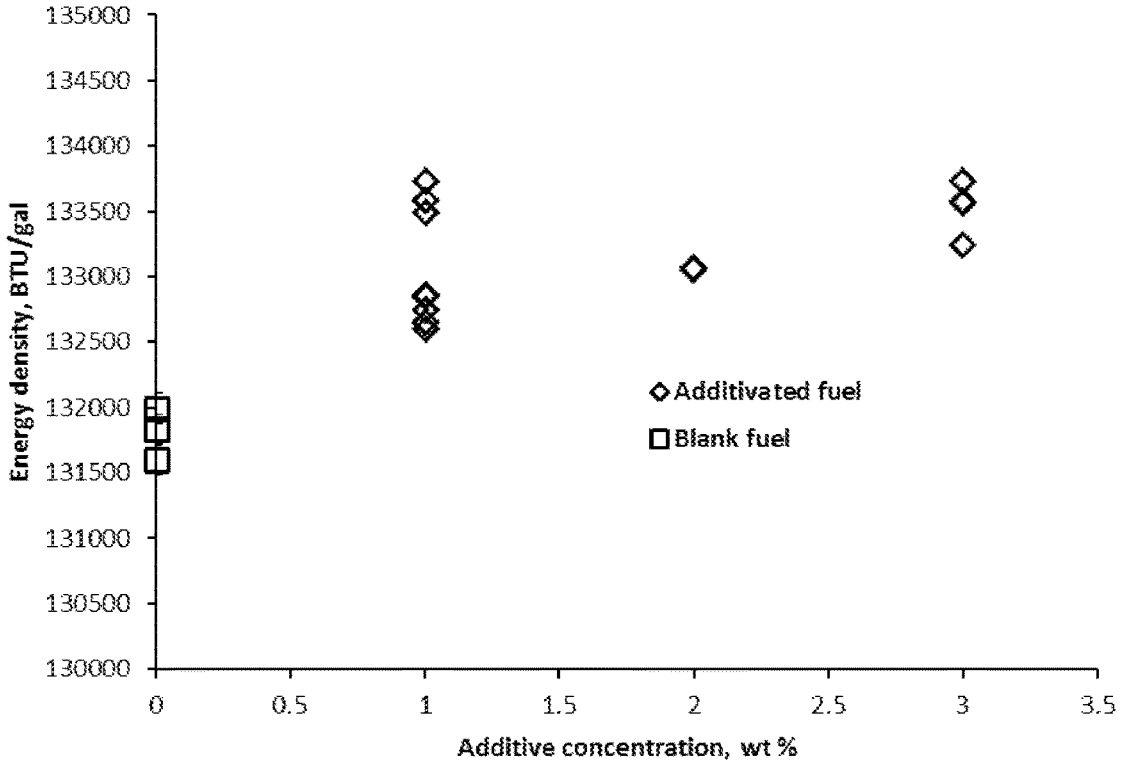

FIG. 4 provides a graph plotting energy density as a function of fuel additive concentration for embodiments of the composition of this invention comprising a liquid hydrocarbon fuel and an alkyl-functionalized graphene oxide fuel additive. For comparative purposes, the energy density of the fuel without the additive (Blank) is also plotted.

Figure 5:
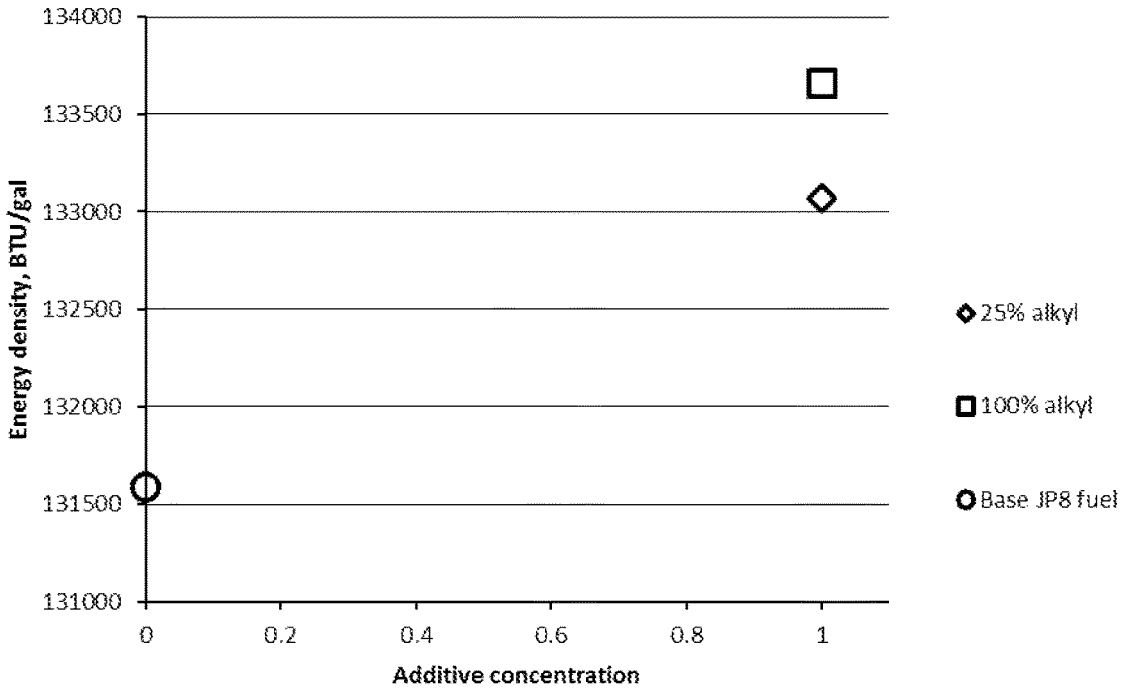

FIG. 5 provides a graph plotting average energy density as a function of fuel additive concentration for embodiments of the composition of this invention comprising a liquid hydrocarbon fuel and an alkyl-functionalized graphene oxide fuel additive. For comparative purposes, the average energy density of the fuel without the additive (Base fuel) is also plotted.

DETAILED DESCRIPTION OF THE INVENTION

For the purposes of this invention, the term "hydrocarbon fuel" shall refer to a mixture of chemical compounds wherein greater than 85 percent, preferably, greater than 90 percent, more preferably, greater than 95 percent, by weight, consists entirely of carbon and hydrogen atoms. Such mixtures are capable of reacting with an oxidant (or oxidizer) in an oxidation or combustion process to form at least one oxidation product, such as partially-oxidized organic compounds, carbon monoxide, carbon dioxide, and water, with release of energy typically in the form of heat. For the purposes of this invention, the hydrocarbon fuel will be found in a liquid state at about ambient temperature, taken herein as 21° C., and about ambient pressure, taken as about 1 atmosphere (101 kPa). Typically, the liquid hydrocarbon fuel will have a boiling point ranging from about −40° C. (−40° F.) to 540° C. (1004° F.) at about 1 atm (101 kPa) pressure.

Liquid hydrocarbon fuels are known in the art to comprise a complex mixture of hydrocarbons, including (n- and iso-) paraffins, monocycloparaffins, di- and tricyclo-paraffins, and aromatic compounds including alkylbenzenes, naphthalenes, biphenyls, phenanthrenes, and the like. The exact formulation of such mixtures varies with the specific fuel, its geographic origin, and how the fuel has been processed. The liquid hydrocarbon fuel may also contain sulfur and/or nitrogen chemically bound to one or more of the hydrocarbon compounds present in the mixture. Generally, sulfur occurs in a concentration up to about 3,000 parts per million (3,000 ppm), but more typically, not more than 400 ppm, even more typically, not more than 100 ppm, by weight, in commercial fuels suitable for transportation purposes. In hydrocarbon-based fuels nitrogen is likely to occur in a concentration not more than 0.3 ppm, by weight. Oxygen functionality, such as hydroxyl, epoxy, and carboxyl groups, typically does not occur in liquid hydrocarbon fuels derived from fossil fuels, but may be present in fuels derived from biomass sources. Typically, oxygen functionality in such fuels does not exceed 10-12 weight percent. For the purposes of this invention, the term "liquid hydrocarbon fuel" does not include nitro-functionalized hydrocarbon propellants, such as nitromethane.

Liquid hydrocarbon fuels are well known in the art, non-limiting examples of which include fossil fuel-derived gasoline, kerosene, diesel, heating oil, bunker fuels, and jet propulsion fuels, including JP-5, JP-8, JP-10, Jet-A, and RP-1, as well as liquid hydrocarbon fuels derived from intermediate refinery processes, such as gas oil and naphtha. Also suitable are liquid hydrocarbon fuels derived from biomass resources, such as, biomass diesel. Preferred liquid hydrocarbon fuels include gasoline, kerosene, diesel, biomass diesel, JP-5, JP-8, JP-10, Jet-A, RP-1, and mixtures thereof.

The fuel additive employed in the composition of this invention comprises a graphitic carbon compound or mixture of graphitic carbon compounds; the graphitic carbon compound comprising a plurality of alkyl group functionalities, wherein at least one alkyl group at each site of functionalization comprises 8 or more carbon atoms. Graphitic carbon consists of a 2-dimensional configuration wherein each carbon atom is packed in a regular array of $sp^2$-bonded, atomic scale hexagonal pattern. Examples of graphitic carbon include, without limitation, graphene including single layer and multi-layer graphenes, carbon nanotubes, including single and multi-walled carbon nanotubes; fullerenes including $C_{60}$ bucky balls, $C_{70}$, $C_{76}$, $C_{78}$, $C_{84}$, and $C_{120}$ fullerenes, and higher homologues thereof; as well as graphene oxide derivatives of the aforementioned materials, and as well graphite and graphite oxide, and mixtures of the aforementioned materials. Preferably, the graphitic carbon comprises graphene compounds containing oxygen functionalities, including epoxy, hydroxyl, and carboxyl functionalities, such oxygen-containing graphitic carbon compounds being referenced herein as "graphene oxide." A description of the aforementioned materials can be found in D. Dreyer, et. al., "The Chemistry of Graphene Oxide," Chemical Society Reviews, vol. 39, 2010, 228-240; M. Terrones, et. al., "Synthesis Properties and Applications of Carbon Nanotubes," vol. 33, 2003, 419-501, incorporated herein by reference.

The art recognizes that an alkyl group (or equivalently, alkyl radical or alkyl substituent) comprises a fully saturated alkane that is missing one hydrogen atom. Acyclic, cyclic, and polycyclic alkyl groups are all suitably employed in this invention. An acyclic alkyl group can be represented by the formula: $C_nH_{2n+1}$, where "n" represents the number of carbon atoms, which can be provided in a straight chain or a branched configuration. A cycloalkyl group can be represented by the formula: $C_nH_{2n-1}$, where again "n" represents the number of carbon atoms. A polycyclic alkyl group, having two or more fused or non-fused alkyl rings, also falls within the scope of this invention. At each site of alkyl functionalization on the graphitic carbon compound, at least one alkyl group is required to comprise at least 8 carbon atoms ($n \geq 8$), preferably, greater than 10 carbon atoms. Preferably, at each site of alkyl functionalization on the graphitic carbon compound, at least one alkyl group comprises less than 30 carbon atoms, more preferably, less than 20 carbon atoms. Non-limiting examples of suitable acyclic alkyl groups include octyl, nonyl, decyl, undecyl, dodecyl, tridecyl, tetradecyl, pentadecyl, hexadecyl, heptadecyl, octadecyl, nonyldecyl, and icosyl, as well as branched homologues thereof, and higher homologues thereof. Suitable non-limiting examples of cycloalkyl groups include trimethylcyclopentyl, dimethylcyclohexyl, ethylcyclohexyl, diethylcyclohexyl, cyclooctyl, and the like. Among polycyclic alkyl groups, one example is decalinyl, the saturated analog of naphthyl. The alkyl group is typically bonded to the graphitic carbon through some other functional atom, such as an oxygen atom or nitrogen atom; but the invention is not limited thereto.

The load of alkyl functionalization on the graphitic carbon can be any load provided that the mixture comprising the liquid hydrocarbon fuel and the alkyl-functionalized graphitic carbon fuel additive exhibits one or more enhanced properties, preferably, enhanced combustion properties, such as energy density, thrust, and/or flame speed, as compared with those properties in the base fuel absent fuel additive. Generally, the load of alkyl functionalization is given as a ratio of number of alkyl carbon atoms relative to number of graphitic carbon atoms ($C_A/C_G$). A typical ratio of alkyl carbon atoms to graphitic carbon atoms is equal to or greater than 1:4, preferably, greater than 1:3. A typical ratio of alkyl carbon atoms to graphitic carbon atoms is equal to or less than 1:1, preferably, less than 1.1.25.

No limitation is imposed on the manner in which the alkyl functionality is introduced into the corresponding unmodified (or non-alkylated) graphitic carbon compound. In one method, an unmodified graphitic carbon compound is functionalized with oxygen-containing groups to provide the corresponding graphitic oxide. Thereafter, the graphitic oxide is converted to the corresponding alkyl-functionalized graphitic oxide.

As an example, the synthesis of alkyl-functionalized graphene oxide will be described in detail. Graphene oxide can be purchased commercially, for example, from Cheap Tubes, Inc. of Brattleboro, Vt. Like graphene, the oxide also consists of a 2-dimensional, crystalline allotrope of carbon, in which carbon atoms are densely packed in a regular array of $sp^2$-bonded, atomic scale hexagonal pattern. Unlike graphene, graphene oxide is functionalized with a plurality of oxygen-containing groups, including on its surface hydroxy and epoxy groups and on its edges hydroxy and carboxyl groups. Generally, the oxygen functionality constitutes greater than about 5 percent, preferably, greater than about 10 percent, by weight, based on the weight of the graphene oxide. Generally, the oxygen functionality constitutes less than about 40 percent, preferably, less than about 30 percent, by weight, based on the weight of the graphene oxide. Of these, the carboxyl functionality is dependent on the synthesis technique and can represent from 30 to 100 percent, by weight, of the total oxygen functionality.

The graphene oxide can be converted to alkyl-functionalized graphene oxide through reactions on the carboxyl [—C(O)OH)] functionalities. It should be recognized that an analogous synthetic method can be used to alkyl-functionalize other graphitic carbon species. For description of a preferred synthetic method, reference is made to S. Choudhary, et al. in "Dispersion of alkylated graphene in organic solvents and its potential for lubrication applications," Journal of Material Chemistry, Vol. 22 (2012), pp. 21032-21039, incorporated herein by reference. In this method, carboxyl functional groups on the graphene oxide are first reacted with thionyl chloride [$S(O)Cl_2$] or another reactive chloro donor compound, to form acyl chloride [—C(O)Cl] functionalized graphene oxide and by-products of hydrogen chloride (HCl) and sulfur dioxide ($SO_2$). A quantity of thionyl chloride is employed equivalent to the number of moles of carboxyl functionality that are desired to be converted to alkyl-containing functionalities. Preferably, at least about 20 percent, more preferably, at least about 40 percent, even more preferably, at least about 60 percent, and most preferably, up to essentially 100 percent of the carboxyl groups are converted with thionyl chloride to the corresponding acyl chloride functional groups.

Subsequently, the acyl chloride functional groups on the graphene oxide are amidated with an amine to form amide linkages that contain long-chain alkyl groups. The chlorine is eliminated from the structure in the form of HCl during this step. The amine can be any primary or secondary amine of general formula: $NHR_2$, wherein, respectively, one or both R groups consist of an alkyl group having at least 8 carbon atoms ($\geq C_8$). When only one R is alkyl as in a primary amine, the other R is hydrogen. The amide linkages have the general formula [$—C(O)NR_2$], wherein one or both R groups derived from the amine consist of the alkyl group having at least 8 or more carbon atoms, as noted hereinabove. The preferred amine has at least one alkyl group of greater than 10 carbon atoms, but less than about 30 carbon atoms, and more preferably, less than about 20 carbon atoms. A quantity of amine is employed in the amidation reaction corresponding to the number of moles of acyl chloride functionality present on the graphene oxide. The aforementioned acylation and amidation reactions do not involve in any substantial way the hydroxy and epoxy functional groups on the graphene oxide. Preferably, a portion of the total oxygen functionality in the starting graphitic carbon compound, in the form of hydroxyl, epoxy, and carboxyl groups, remains intact in the alkyl-functionalized graphitic carbon compound. This portion of oxygen functionality remaining in the alkyl-functionalized additive preferably ranges from about 10 percent to about 50 percent of the total oxygen functionality.

The resulting alkyl-functionalized graphitic carbon compound generally has a particle size correlating substantially to the particle size of the unmodified graphitic carbon starting material. Since the materials are essentially two-dimensional, the thickness of the particles will be significantly smaller than the width of the particles. As a guide, when graphene oxide is modified as described hereinabove, the thickness of the resulting alkyl-functionalized graphene oxide ranges from about 2 nanometers (2 nm) to less than about 50 nm, as determined by transmission electron microscopy (TEM) or scanning electron microscopy (SEM). The width of the particles ranges from greater than about 100 nm, preferably, greater than about 200 nm, to less than about 3 microns (μm), preferably, less than about 2 μm. Various conventional methods, such as ball-milling, sonication, and sieving, can be employed to modify the size of the particles and/or to select a range of desired particle sizes.

The fuel additive comprising the alkyl-functionalized graphitic carbon compound is solubilized, dispersed, or suspended in the liquid hydrocarbon fuel for the purpose of enhancing one or more properties of the fuel, preferably, the combustion properties of the fuel, particularly, for enhancing fuel energy density, thrust, flame speed, or some combination thereof. The fuel additive is provided to the liquid fuel in a concentration generally greater than about 0.1 percent, and for increased effect on energy density preferably greater than about 0.5 percent, by weight, based on the weight of the liquid fuel. The fuel additive is provided to the liquid fuel in a concentration generally less than about 50 percent, preferably, less than about 25 percent, by weight, based on the weight of the liquid fuel.

We have discovered that the stabilized composition of this invention comprising the liquid hydrocarbon fuel and the fuel additive comprising the alkyl-functionalized graphitic carbon can be stably stored with acceptable shelf life. At lower concentrations of fuel additive, for example from 0.1 to 0.5 weight percent, the composition can be stored for a considerable time, i.e., up to about one month, with little, if any, sedimentation or agglomeration of the fuel additive. It has also been discovered that longer alkyl chains are correlated with longer shelf life. As an example, a C8 alkyl chain can provide for a stable mixture of liquid hydrocarbon fuel and fuel additive for about 20 hours; whereas a C18 alkyl chain can provide for a stable composition of liquid hydrocarbon fuel and fuel additive for at least 1 month at concentrations between 0.1 and 1 weight percent. The stabilized composition of this invention, comprising the liquid hydrocarbon fuel and the fuel additive comprising the alkyl-functionalized graphitic carbon compound, is stable typically for at least about 20 hours, preferably at least about 100 hours, more preferably, at least about 250 hours, even more preferably, at least about 400 hours, and most preferably, at least about 600 hours, or more. Testing for sedimentation can be accomplished visually with photographic documentation. The liquid mixture can also be decanted and residue of insoluble fuel additive, if any, can be weighed. The stabilized composition appears homogeneous, with essentially no phase layering, with less than about 10 weight percent, more preferably, less than about 3 weight percent, of the fuel additive being recovered as sediment.

We have discovered that addition of the fuel additive comprising the alkyl-functionalized graphitic carbon compound to the liquid hydrocarbon fuel results in improved fuel properties. Chiefly, the energy density of the liquid hydrocarbon fuel was found to be increased, as compared to the fuel in absence of the fuel additive. For the purposes of this invention, the term "energy density" is defined as the amount of energy stored in a given volume of fuel, for example, in units of kilojoules per liter (KJ/l) or British thermal units per gallon (BTU/gal). Energy density is calculated by multiplying two measured parameters: the Lower Heating Value (LHV) of the fuel per unit weight (BTU/lb or J/g) obtained from bomb calorimetry experiments and the Specific Gravity of the fuel in units of weight per volume (lb/gal or g/l) measured, for example, by the well-known hydrometer-meniscus method. The measurements are made of the composition of this invention comprising the liquid hydrocarbon fuel and the fuel additive and compared with similar measurements made on the liquid hydrocarbon fuel without the fuel additive. It is believed that increased energy density results in increased ignition and burn rate. The composition of this invention can be used to produce an energy density increase of about 1 percent, and preferably 2 percent or more, as compared with the fuel absent fuel additive.

Another advantage of the stabilized composition of this invention, comprising the liquid hydrocarbon fuel and the alkyl-functionalized graphitic carbon compound, involves increased flame speed and combustion reactivity. Tests can be conducted to document the length of a flame during combustion of the fuel, with and without fuel additive. Flame length correlates with flame speed. A shorter flame indicates increased flame speed. In this invention, the addition of fuel additive to the liquid hydrocarbon fuel shortened flame length, resulting in a higher flame speed.

If desired, a conventional metal or metalloid fuel additive, such as any of the metal oxides, hydroxides, and oxyhydroxides mentioned hereinbefore, can be added to the composition of this invention. Such metal or metalloid additives may further increase one or more combustion properties of the fuel, even if storage stability is reduced. The addition of metal or metalloid fuel additives will also produce a combustion signature and emissions that otherwise are avoided when using the graphitic carbon compound alone.

Applicants envision that the fuel composition of this invention comprising the liquid hydrocarbon fuel and the alkyl-functionalized graphitic carbon compound can be employed in any oxidation process, including full and partial oxidation processes, flame diffusion combustion processes, and catalytic and non-catalytic combustion processes. The art recognizes full combustion as conversion of fuel to carbon dioxide and water; whereas the art recognizes partial oxidation as conversion of fuel to partial oxidation products, including but not limited to carbon monoxide, hydrogen, and oxygen-functionalized hydrocarbons. Such processes require an oxidant (or oxidizer), non-limiting examples of which include pure oxygen, oxygen in mixtures with nitrogen, including air; ozone; oxygen in mixtures with inert gases (helium, neon, argon, xenon); hydrogen peroxide, organic hydroperoxides, nitrogen oxides, nitrates, and carbon dioxide. Preferred oxidants comprise essentially pure oxygen, mixtures of oxygen and nitrogen, including air, and mixtures of oxygen and inert gases. Process conditions for oxidation and combustion processes vary widely depending upon the specific fuel to be oxidized, the specific oxidant, the ratio of fuel to oxidant (e.g., lean, stoichiometric, rich), whether or not a catalyst is employed, and whether or not the process is run flameless or in flame mode. Temperature can range broadly from as low as 50° C. to as high as 3,000° C. Pressure can range from sub-atmospheric or super-atmospheric, with atmospheric often preferred.

The following examples are provided as an illustration of the invention described herein. These examples should not be construed to limit the invention in any manner. The skilled person will recognize that variations in materials and process steps falling within the scope of the invention can be substituted for the specific species described herein.

Example 1

Various alkyl-functionalized graphene oxide samples were synthesized and characterized by conventional analytical methods. Each sample was added to a liquid hydrocarbon fuel, namely JP-8, to yield an embodiment of the composition of this invention. The storage stability of each prepared composition of this invention was evaluated over 650 hours of test time.

Graphene oxide containing 25 percent by weight total oxygen functionalization as epoxy, hydroxl, and carboxyl groups was obtained from Cheap Tubes Inc, Brattleboro, Vt. All other chemicals were purchased from Sigma-Aldrich. In order to increase the compatibility of graphene oxide with liquid hydrocarbon fuels, the graphene oxide was functionalized with a plurality of alkyl chains having 8 or more carbon atoms, by coupling an alkyl amine with the carboxyl groups located on the graphene oxide. Alkylation was accomplished through a two-step method as described by S. Choudhary, et al., in "Dispersion of alkylated graphene in organic solvents and its potential for lubrication applications," J. Mater. Chem., 2012, 22, 21032-21039. The method consisted of first activating a portion or all of the aforementioned carboxyl groups by reaction with thionyl chloride ($SOCl_2$). By reacting the graphene oxide with different ratios of thionyl chloride, various proportions of the carboxyl groups were activated to chloroacyl groups [—C(O)Cl]. In a second step, the graphene oxide with activated chloroacyl groups was reacted with an (≥C8)-alkylamine, typically in absence of solvent, at a temperature between 100° C. and 120° C. to introduce alkyl chains via an amide linkage [—C(O)(NHR)]. Hydrogen chloride was released during this reaction. The alkylamine was selected from octylamine (C8) and octadecylamine (C18). Samples were prepared wherein either 100%, 75%, 50%, or 25% of the initial carboxyl functionality was converted to alkylamide functionality. Table 1 summarizes the alkyl-modified samples prepared, the length of the alkyl chain, and alkyl loading as a percentage of initial carboxyl groups.

TABLE 1

Alkyl-functionalized Graphene Oxide (Fuel Additive)[1]

| Sample #1 | Alkyl Chain Length[2] | Alkyl Loading[1] | Stability in JP-8 Fuel[3] (hours) |
|---|---|---|---|
| (a) | C18 | 25% | ≥650 h |
| (b) | C18 | 50% | ≥650 h |
| (c) | C18 | 75% | ≥650 h |
| (d) | C18 | 100% | ≥650 h |
| (e) | C8 | 75% | >20 h but <300 h |

[1]Graphene oxide: initial oxygen functionality = 25 weight percent of which 50% was carboxyl functionality. Alkyl loading given as a percentage of carboxyl groups reacted.
[2]C8 = octylamine; C18 = octadecylamine.
[3]Stability measured in compositions of JP-8 fuel and 0.1-0.3 wt % additive. At 650 hours, test was voluntarily stopped.

The alkylated graphene samples were analyzed by transmission electron microscopy (TEM) using a Phillips 120 kV microscope. The TEM samples were sonicated in ethanol dispersed on a holey carbon grid prior to imaging. The samples were also analyzed using an ISI-DS 130S dual stage Scanning Electron Microscope (SEM). Prior to imaging, the SEM sample was dispersed on carbon tape. TEM and SEM microscopy were utilized to investigate the structure of the alkyl-functionalized graphene oxide (100% alkylated) and the unmodified graphene oxide starting material. Both unmodified graphene oxide and alkyl-functionalized graphene oxide showed similar thin platelet structures; but the alkyl-functionalized graphene oxide showed more rugged edges and more defective structures likely due to chemical modification. The unmodified graphene oxide appeared as sheets measured at several tens of micrometers wide. Based on the transparency of the material, the thickness was found to be no more than 2-5 nanometers (nm). No evidence of regraphitization or agglomeration of the graphene layers in the alkyl-modified samples was found.

With reference to FIG. 1 of the Drawings, infrared (IR) spectra were collected using a Nicolet Magna 550 IR spectrometer. Prior to spectra collection, the alkyl-functionalized graphene oxide samples were pelletized using KBr as a diluent. The IR was used to investigate the structure of the alkylated graphene oxide and confirm the synthesis reaction sequence. In the alkyl-modified samples, two signals were observed, one around 3000 $cm^{-1}$ assigned to alkyl chains (C—H bonds) and the other a set of spectral features around 1500 $cm^{-1}$ assigned to amide functionality, as expected if the alkyl chains were successfully linked to the graphene oxide edges. Both signals were present in all modified graphene oxide samples, but absent in the unmodified graphene oxide starting material. The signal coming from carboxyl groups at about 1700 $cm^{-1}$ was strong in the unmodified graphene oxide, but considerably weaker or absent in the alkyl-modified samples, as expected when the carboxylate functionality reacted with the amine to form the amide linkage. Spectral features resulting from other oxygen-containing groups (-hydroxyl and -epoxy) were observed in both the unmodified and alkyl-modified graphene oxide samples.

The alkyl-functionalized graphene oxide samples were further analyzed via thermogravimetric analysis (TGA) collected in a Setaram Setsys 1750 instrument under air flow. An initial weight change in the sample was monitored over a temperature program from 20° C. to 1000° C. at 5 K/min under flowing air for two successive ramps. FIG. 2 illustrates TGA data collected for unmodified graphene oxide and two alkyl-functionalized graphene oxide samples (100% alkylated C-18 and 25% alkylated-C18). The oxidation weight loss data was normalized to 1 mg for all samples. The derivative of the weight loss as a function of temperature was plotted, as illustrated in FIG. 3, giving a more comprehensive image of the sample weight loss. All of the weight loss registered below 100° C. was attributed to water. Note that the unmodified graphene oxide exhibited a more pronounced water weight loss (up to 20% of the sample was lost before 100° C.), due to its high affinity for polar solvents such as water. Virtually no weight loss was recorded for the alkyl-modified graphene oxide below 100° C., due to its higher hydrophobicity, which correlated to the fact that the alkyl-modified samples were more compatible with liquid hydrocarbon fuels.

Following loss of water, two additional weight-loss zones were identified. Between 200° C. and 350° C., weight loss was due to thermal decomposition of oxygen carrying functionalities. This weight loss was more pronounced and occurred at lower temperature for the unmodified graphene oxide sample. With the addition of alkyl groups the weight loss due to oxygen carrying functionalities shifted to higher temperatures and was less dominant for the higher alkyl-functionalized samples (e.g., 100% alkylated graphene). The second weight loss interval occurred around 550-600° C. and was attributed to thermal decomposition of the more stable graphitic domains. The higher alkylated sample registered more weight loss in this temperature range. The 25% alkylated sample showed a weight loss around 450° C. attributed to the presence of unreacted carboxyl groups, since not all of these were activated for alkylation. The TGA data confirmed the alkyl modification of graphene oxide by showing less oxygen function derived thermal decomposition for the alkylated samples, as expected when a portion of the oxygen containing groups was linked to alkyl chains. Furthermore, the more alkyl groups were present, the more the thermal decomposition shifted to higher temperatures and graphitic domains, indicative that the synthetic method resulted in different degrees of alkylation.

The TGA data also showed that all of the alkylated graphene oxide was consumed in the TGA oxidation process, i.e. none of the original sample remained post TGA. This result emphasizes an important advantage over metallic additives, where residue is expected even at high temperatures inside a combustion chamber.

Overall, the combustion of the alkyl-functionalized graphene oxide took place at higher temperatures, as compared with the unmodified graphene oxide. At the temperature at which a weight loss was initially registered in the alkyl-functionalized graphene oxide (around 250-300° C.), almost 50% of the unmodified graphene oxide was already combusted, making the alkyl-modified additive more thermally stable than the unmodified graphene oxide.

Preparation of Composition of Invention Comprising Liquid Hydrocarbon Fuel and Fuel Additive (Alkyl-Functionalized Graphene Oxide)

Formulations representative of the invention comprising a liquid hydrocarbon fuel and an alkyl-functionalized graphene oxide fuel additive were prepared as follows. The fuel selected was JP-8. The alkyl-functionalized fuel additives included the 25%, 50%, 75%, and 100% C18-alkylfunctionalized graphene oxide and the 75% C8-alkylfunctionalized graphene oxide samples synthesized as described hereinabove. The alkyl-functionalized fuel additive was dispersed in the liquid hydrocarbon fuel in a concentration ranging from 0.1 to 3.0 weight percent, based on the weight of the fuel. All dispersions were synthesized by placing the mixture containing the JP-8 fuel and a pre-weighed amount of the fuel additive in an ultra-sonicator bath for up to 30 minutes at 20° C. to ensure uniform dispersion of additive.

Following dispersion, the fuel-additive mixtures were left untouched and observed over extended periods of time ~up to 650 hours for the lower concentration samples. Digital images of the suspensions were recorded at uniform time intervals, usually every 24 hours. Back illumination was used in some samples to assess any degree of settling. For higher concentration samples the sample bottle was carefully tilted to observe if any deposits settled to the bottom.

Within 10 minutes after mixing, the compositions of this invention comprising JP-8 fuel and the alkyl-modified graphene oxide fuel additive were stable in suspension; while a comparative sample of JP-8 fuel and unmodified graphene oxide was already mostly settled. At 20 hours all of the invention samples containing the alkyl-functionalized graphitic fuel additive remained stable. Moreover, the invention samples containing the C18-alkyl functionalization remained stable for a long period of time thereafter. Refer to details in Table 1. Whereas the comparative sample of unmodified graphene oxide was already separated at 10 minutes; the C18-functionalized compositions of the invention remained stable suspensions at 300 hours. While the C8-alkyl graphene oxide was stable out to 20 hours, it was segmented at 300 hours.

Surprisingly, embodiments of this invention comprising JP-8 fuel and the C18-alkyl-functionalized graphitic carbon compound were stable for 650 hours, after which the test was voluntarily stopped.

Example 2

Compositions of this invention comprising JP-8 fuel and an alkyl-functionalized graphene oxide fuel additive were evaluated at Atlantic Product Services Inc. of New Jersey, a jet fuel testing facility. Each sample was analyzed by bomb calorimetry in accordance with standard method ASTM D240. For each sample the bomb calorimetry measurements were reported as Lower Heating Value (LHV) per unit weight of fuel sample (e.g., BTU/lb or kJ/g). Gravimetric fuel density (Specific Density, SG) was also measured at Atlantic Product Services, Inc. using standard method ASTM D4052. Applicants also measured Specific Gravity (SG) in Applicants' laboratory using the well-known hydrometer-meniscus method. Specific gravity is reported as weight per volume fuel, e.g. lb/gal or g/l. Energy density, given in units of BTU/gallon (BTU/gal) or kiloJoules/liter (KJ/l), was calculated as a product of the LHV/wt times the Specific Gravity. The energy densities calculated from both laboratories fell within 2% of each other; and the final values reported herein are an average over all measurements.

Table 2 lists results, which are also graphed in FIG. 4. In particular, FIG. 4 plots energy density as a function of additive concentration. For comparative purposes, the energy density measurements on a blank JP-8 fuel sample, i.e., without modified graphene oxide additive, are also shown.

TABLE 2

Energy density calculations derived from TGA data[1,2]

| Additive type | Conc. (Wt. %) | LHV[2] KJ/Kg | SG[2] Kg/m$^3$ | Energy density KJ/l |
|---|---|---|---|---|
| None[3] | 0 | 45959.2 | 794.3 | 366692.5 |
| None[3] | 0 | 46042.7 | 794.3 | 367359.3 |
| None[3] | 0 | 46098.4 | 794.3 | 367802.9 |
| 25% alkylated | 1 | 45861.8 | 803.9 | 370104.7 |
| 100% alkylated | 1 | 46188.9 | 803.9 | 372696.6 |
| Mix of additives[4] | 1 | 45959.2 | 803.9 | 370637.6 |
| Mix of additives[4] | 1 | 45938.3 | 803.9 | 370676.6 |
| Mix of additives[4] | 2 | 45868.7 | 806.3 | 371265.3 |
| 25% alkylated | 3 | 45729.5 | 809.8 | 371745.2 |
| 100% alkylated | 3 | 45954.6 | 807.5 | 372651.9 |
| 25% alkylated | 1 | 46149.4 | 803.9 | 372425.9 |
| 100% alkylated | 1 | 46237.6 | 803.9 | 373090 |
| Mix of additives[4] | 1 | 45924.4 | 803.9 | 370355.8 |
| Mix of additives[4] | 1 | 45850.2 | 803.9 | 369965.2 |
| Mix of additives[4] | 2 | 45864.1 | 806.3 | 371229 |
| 25% alkylated | 3 | 45896.6 | 809.8 | 373103.9 |
| 100% alkylated | 3 | 45956.9 | 807.5 | 372671.5 |

[1]Mixtures of JP-8 fuel and C18-alkyl-modified graphene oxide.
[2]LHV = Lower Heating Value; SG = specific gravity
[3]Comparative Experiments using fuel without additive.
[4]Mix of additives = 50 wt. % of 25% additive plus 50 wt. % of 100% additive, where 25% and 100% refer to percentages of carboxyl groups converted to alkylamide.

It is seen from Table 2 and FIG. 4 that the addition of alkyl-functionalized graphene oxide to JP-8 fuel increased the energy density of the fuel. A higher percentage of alkyl functionality on the graphene oxide resulted in a higher fuel energy density. Likewise, a higher concentration of alkyl-functionalized graphene oxide in the fuel resulted in a higher fuel energy density. FIG. 5 plots the average energy density for all measurements as a function of fuel additive concentration. It is seen from FIG. 5 that the fuel additive increased the energy density of the fuel by at least 1 percent up to 1.6 percent on average.

Example 3

A simulated combustor was fabricated using an air blast atomizing nozzle to direct a stream of fuel into an optically accessible, cylindrical quartz combustion chamber. The fuel flow was controlled using a calibrated external fuel pump. Air flow to the combustor consisted of the atomizing air, plus an additional air inlet provided through a cap to introduce air tangential to the combustor creating a high swirling flame zone in the combustor. The advantage to this design allowed full optical access to the flame zone. A flow of 7 g/min fuel was used with sufficient air to achieve an overall equivalence ratio of 1.0 (stoichiometric operation) to obtain a stable, robust flame with JP-8 fuel.

Combustion of the compositions of this invention, comprising JP-8 fuel and fuel additive comprising the alkyl-functionalized graphitic carbon compound, were studied and compared with combustion of JP-8 fuel absent the fuel additive (blank or base fuel). The base fuel and fuel samples containing additive were tested under identical conditions. For each series of experiments JP-8 fuel without additive was tested first, followed by testing fuel containing additive. The fuel feed was switched between the two fuels without extinguishing the flame. Photographic images were collected during each experiment. It was observed that the compositions representative of this invention, namely, the fuel containing additive, produced stable, robust flames. No evidence of un-combusted additive was found when the flame was extinguished. Some soot was deposited on the combustion tube from both the JP-8 and the JP-8 with additive, in comparable amounts.

Using imaging software flame length was measured and averaged from 22 images for each fuel. With reference to Table 3, flame length measurements resulting from combustion of the compositions of this invention, comprising JP-8 and alkyl-functionalized graphene oxide fuel additive, were shorter by 10 to 20 percent, as compared with blank JP-8 without the fuel additive. Flame contraction was attributed to higher flame speed, in turn favorable to increased engine thrust.

TABLE 3

Average Flame Length Measurements for Combustion of JP-8 Fuel (with and without Fuel Additive)

| Additive loading, wt % | Average Flame Length[1] (cm) | Flame Contraction % |
|---|---|---|
| 0[2] | 29.3 | 0.0 |
| 0.1 | 25.8 | 12.0 |
| 0.4 | 23.8 | 18.6 |
| 1.0 | 26.2 | 10.6 |

[1]Average of 22 measurements
[2]Comparative Experiment using JP-8 without additive.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A composition comprising a liquid hydrocarbon fuel and a fuel additive, wherein the fuel additive comprises a graphitic carbon compound functionalized with a plurality of alkyl groups, wherein at least one alkyl group at each site of alkyl functionalization on the graphitic carbon compound comprises 8 or more carbon atoms, wherein the graphitic carbon compound functionalized with a plurality of alkyl groups is synthesized from graphene oxide having an oxygen functionality ranging from greater than 10 to less than 40 percent by weight, based on the total weight of the graphene oxide.

2. The composition of claim 1 wherein the liquid hydrocarbon fuel has a boiling point ranging from about −40° C. to about 540° C. and about 101 kPa.

3. The composition of claim 1 wherein the liquid hydrocarbon fuel is selected from the group consisting of gasoline, diesel, kerosene, naphtha, gas oils, heating oils, bunker oils, jet propulsion fuels, and fuels derived from biomass resources.

4. The composition of claim 1 wherein the graphitic carbon compound is selected from the group consisting of single-layer and multi-layer graphenes, single-layer and multi-layer graphene oxides, single-walled and multi-walled carbon nanotubes, fullerenes, graphene oxide derivatives of single-walled and multi-walled carbon nanotubes and fullerenes, graphite, graphite oxide, and mixtures thereof.

5. The composition of claim 1 wherein the at least one alkyl group at each site of alkyl functionalization comprises greater than 10 and less than 30 carbon atoms, and wherein each alkyl group is individually selected from acyclic, cyclic, and polycyclic alkyl groups.

6. The composition of claim 1 wherein the graphitic carbon compound has a ratio of alkyl carbon atoms to graphitic carbon atoms ranging from equal to or greater than 1:4 to equal to or less than 1:1.

7. The composition of claim 1 wherein from 30 to 100 percent of the oxygen functionality on the graphene oxide is present as carboxyl functional groups.

8. The composition of claim 7 wherein from 25 to 100 percent of the carboxyl functional groups are converted to alkyl groups.

9. The composition of claim 1 wherein the graphitic carbon compound is provided in a particle size ranging from greater than 100 nm to less than 2 nm in width and from greater than 2 nm to less than 50 nm in thickness.

10. The composition of claim 1 wherein the graphitic carbon compound is present in a concentration ranging from greater than 0.1 percent to less than 50 percent, by weight, based on the weight of the liquid hydrocarbon fuel.

11. The composition of claim 1 having a storage stability greater than 250 hours.

12. A method of increasing energy density of a liquid hydrocarbon fuel comprising adding to the liquid hydrocarbon fuel a graphitic carbon compound functionalized with a plurality of alkyl groups, wherein at least one alkyl group at each site of alkyl functionalization on the graphic carbon compound comprises 8 or more carbon atoms, the graphitic carbon compound being added to the fuel in a concentration effective to increase the energy density of the fuel, wherein the concentration of graphitic carbon compound in the liquid fuel ranges from greater than 0.1 percent to less than 50 percent, by weight, based on the weight of the liquid fuel.

13. The method of claim 12 wherein the liquid hydrocarbon fuel is selected from the group consisting of gasoline, diesel, kerosene, naphtha, gas oils, heating oils, bunker oils, jet propulsion fuels, and fuels derived from biomass resources.

14. The method of claim 12 wherein the graphitic carbon is selected from the group consisting of single-layer and multi-layer graphenes, single-layer and multi-layer graphene oxides, single-walled and multi-walled carbon nanotubes, fullerenes, graphene oxide derivatives of single-walled and multi-walled carbon nanotubes and fullerenes, graphite, graphite oxide, and mixtures thereof.

15. The method of claim 12 wherein each alkyl group functionality is individually selected from acyclic, cyclic, and polycyclic alkyl groups, and each alkyl group individually has greater than 10 and less than 30 carbon atoms.

16. An oxidation process comprising contacting a liquid hydrocarbon fuel with an oxidant in the presence of a graphitic carbon compound functionalized with a plurality of alkyl groups, wherein at least one alkyl group at each site of alkyl functionalization on the graphitic carbon compound comprises 8 or more carbon atoms, the contacting of fuel and oxidant occurring under process conditions sufficient to produce at least one oxidation product.

17. The oxidation process of claim 16 wherein the liquid hydrocarbon fuel is selected from the group consisting of gasoline, diesel, kerosene, naphtha, gas oils, heating oils, bunker oils, jet propulsion fuels, fuels derived from biomass resources, and mixtures thereof.

18. The oxidation process of claim 16 wherein the oxidant is selected from essentially pure oxygen, mixtures of oxygen and nitrogen, mixtures of oxygen and an inert gas, ozone, nitrogen oxides, nitrates, hydrogen peroxide, organic hydroperoxides, and carbon dioxide.

19. The oxidation process of claim 16 wherein the alkyl-functionalized graphitic carbon compound is selected from the group consisting of single-layer and multi-layer graphenes, single-layer and multi-layer graphene oxides, single-walled and multi walled carbon nanotubes, fullerenes, graphene oxide derivatives of single-walled and multi-walled carbon nanotubes and fullerenes, graphite, graphite oxide, and mixtures thereof.

20. The oxidation process of claim 16 wherein full combustion products comprising carbon dioxide and water are produced; or wherein partial oxidation products comprising carbon monoxide and hydrogen are produced.

21. The oxidation process of claim 16 wherein the process is conducted in the presence or absence of a catalyst.

22. The oxidation process of claim 16 wherein the process is conducted flamelessly or in flame mode.

* * * * *